US005797495A

United States Patent [19]

Lerrick

[11] Patent Number: 5,797,495

[45] Date of Patent: Aug. 25, 1998

[54] SERVING TRAY

[76] Inventor: Andrew J. Lerrick, 323 N. Kings Hwy., #813, St. Louis, Mo. 63108

[21] Appl. No.: 210,078

[22] Filed: Mar. 17, 1994

Related U.S. Application Data

[63] Continuation of Ser. No. 33,330, Jan. 12, 1993, abandoned.

[51] Int. Cl.[6] ..... A47G 23/00

[52] U.S. Cl. ..... 206/554; 206/503; 270/608; 294/172

[58] Field of Search ..... 206/557, 560, 206/561, 503, 507, 509, 511, 518, 519; 220/608; 229/2.5 R; 294/172

[56] References Cited

U.S. PATENT DOCUMENTS

| | | | |
|---|---|---|---|
| Re. 27,688 | 6/1973 | White et al. . | |
| 214,529 | 4/1879 | Smith . | |
| D. 230,810 | 3/1974 | Ryan, Jr. . | |
| D. 246,945 | 1/1978 | Shore . | |
| 995,114 | 6/1911 | Clark et al. . | |
| 1,953,933 | 4/1934 | Gundelach . | |
| 2,295,860 | 9/1942 | Oliver . | |
| 2,606,586 | 8/1952 | Hill | 206/518 X |
| 2,723,068 | 11/1955 | Etwein . | |
| 3,162,344 | 12/1964 | Sabol . | |
| 3,315,858 | 4/1967 | Horner . | |
| 3,318,283 | 5/1967 | Maclam et al. | 206/557 X |
| 3,504,832 | 4/1970 | Corvetti . | |
| 3,578,204 | 5/1971 | Bloch et al. | 229/2.5 R |
| 3,695,424 | 10/1972 | Cristy et al. | 229/2.5 R |
| 3,941,286 | 3/1976 | Perkinson . | |
| 4,010,867 | 3/1977 | Jones | 220/608 |
| 4,174,782 | 11/1979 | Obsomer | 220/608 X |
| 4,461,396 | 7/1984 | Harper . | |
| 4,744,597 | 5/1988 | Bauman et al. . | |

*Primary Examiner*—Jacob K. Ackun
*Attorney, Agent, or Firm*—Bierman, Muserlian and Lucas

[57] ABSTRACT

A serving tray having a substantially planar tray portion with a top surface, bottom surface and periphery; the tray portion being provided with a gripping surface and at least one base ring extending from the bottom surface. The gripping surface and base ring are positioned on the tray so that, when one of the gripping surface and the base ring is gripped by the fingertips of the user's hand, the other can be engaged by the server's thumb.

12 Claims, 6 Drawing Sheets

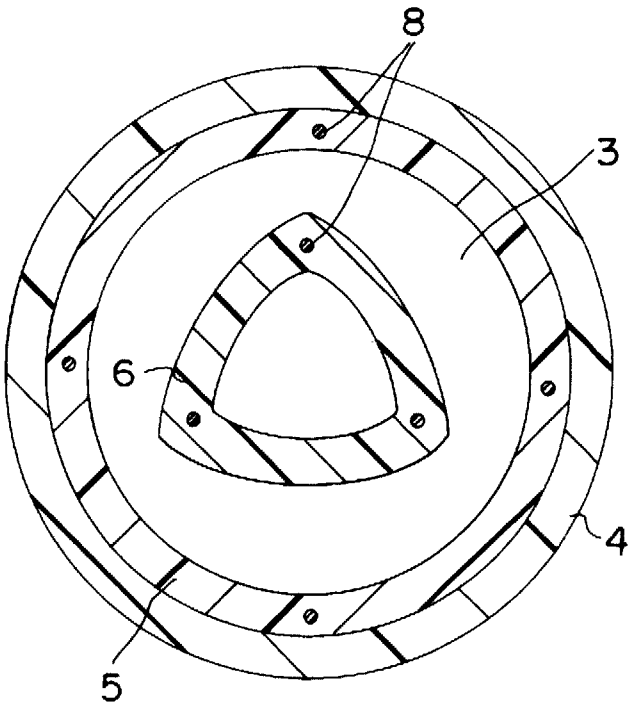
FIG. IB
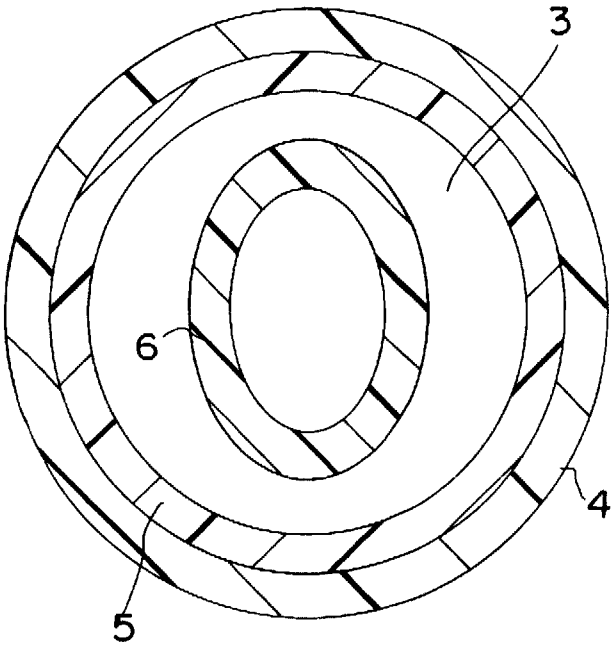
FIG. IA

SERVING TRAY

This application is a continuation of application Ser. No. 08/003,300, filed Jan. 12, 1993, now abandoned.

The present invention is directed to a serving tray and, more specifically, a serving tray that allows the user to carry a load on the top surface of the tray in a balanced manner, with only one hand while, at the same time, minimizing muscle fatigue and spillage. The invention is based upon the novel concept of using the thumb on the underside of the tray as the primary means of balance and support, with peripheral counter-balance, support, and stability being maintained by the palm and digits on the periphery of the tray. The thumb acts as a central fulcrum and is stabilized by a rigid ring located on the base of the serving tray. This concept dramatically changes the role of the hand from that of a "balancing" system to that of a "grip" system. It also incorporates a secure three-point fixation system between the thumb, the index finger, and the fifth digit. The invention allows for variation in hand size and ambidextrous use. This design will diminish stress on the fingers, reduce the strain on the flexor tendons, and likely decrease the incidence of carpal tunnel syndrome. The invention further allows the aforegoing to be accomplished while maintaining a perfectly planar top surface.

BACKGROUND OF THE INVENTION

The act of serving food and beverages in the environment of a crowded restaurant is far more of an art than would appear to the casual observer. Servers are required to handle many differently sized and weighted portions on a single tray. With the removal of each portion, the center of gravity of the loaded tray can change drastically. As one hand is needed to serve the food, only a single hand is left to support the tray. Also, the server must remain mobile in order to move from station to station and to avoid other patrons who may pass while the food is being transported or served. Further, the balancing of a heavily laden tray upon the single hand of a server can cause substantial muscle fatigue and tendon strain. In rare instances, chronic tendonitis of the flexor tendons of the hand and carpal tunnel syndrome have developed. More uncommon are cases of brachial plexus injury caused by direct pressure at the root of the neck near the collarbone from supporting heavy serving trays. Add together the foregoing factors, and it becomes apparent that the skills of a circus juggler and acrobat would not be lost on the average waiter.

In order to ease the burden on the server and to improve the balancability of the serving trays, a number of approaches were taken in the past. As shown in any of U.S. Pat. Nos. 1,953,933; 2,295,860; and 4,461,396; a tray is provided with an opening or perforation extending completely through from the bottom to the top of the tray, close to the center of gravity thereof, through which the thumb is inserted to afford a better grip. While the insertion of the thumb through the opening does improve the gripability of the tray, and makes the balancing thereof easier, this solution also creates a host of new problems. Because a hole is formed in the tray surface, and the thumb is inserted therein, the top surface of the tray is no longer planar. Thus, it is possible that, during transit, the items on the top of the tray, which may include top-heavy glassware such as some cocktail glasses and eating utensils such as knives, can shift and contact the thumb, causing spillage or injury. Further, when used with large trays which can be heavily loaded, the insertion of the thumb through the hole may cause an undue amount of stress thereon. Extremely large thumbs may not even be able to pass through the hole.

Another related solution is shown in U.S. Pat. No. 995,114, which teaches a bottom surface having individual finger holes through which fingers are inserted, but do not reach through to the top surface. Again, the insertion of the digits into a heavily loaded tray can cause undue stress thereon and further, as the tray relies on discretely placed holes for the placement of the fingers, the tray cannot adapt to servers having vastly different hand sizes and proportions. Thus, a tray formed with finger placement adapted to the hands of a large male may not feel comfortable to a small framed female. Also, the fixed hole position limits ambidextrous use. This design poses difficulties in cleaning the base of the tray causing hygiene concerns in the restaurant setting.

Another prior art solution is shown in U.S. Pat. No. 3,504,832. This reference teaches a tray having a channel formed on the underside thereof to accept the forearm of the user. At the center of the tray, within the channel, there is provided a grip around which the hand can be placed. This allows the tray to be supported by the combination of the clenched hand of the server and the forearm. While this provides an adequate two point support system when the tray is held at serving height, problems can be encountered in the instance the tray has to be raised, for example, when one waiter must avoid a second server, when coming out of a kitchen doorway, or when passing a customer. When raised, the second point of support, the forearm, is lost and the tray is gripped only by the handle provided at the center of the channel. If the tray is not perfectly balanced at this point, it can tip either forward or back along the axis of the channel, spilling the contents of the tray.

Composites of the above-described trays are also described in, for example, U.S. Pat. No. 3,941,286 which teaches a sleeve attached to one side of the tray through which the server's hand is inserted, with digits thereof extending through openings so that the top and bottom surface of the tray can be simultaneously gripped. While such a tray even further assists in balancing, all the foregoing problems are encountered, as there is a raised portion on the upper surface, and the height of the tray cannot be easily adjusted with one's hand fixed within the provided sleeve. Thus, it is clear that none of these prior art trays adequately addresses the problems encountered by the user.

BRIEF DESCRIPTION OF THE INVENTION

In view of the foregoing, it is an object of the present invention to provide a serving tray which allows the server to better balance a load thereon, while maintaining an uninterrupted planar top surface onto which food and related items can be loaded. The inventive tray is simple, inexpensive and, due to its configuration, allows for easy manufacture. Other objects and features of the present invention will become apparent in the following detailed description considered in conjunction with the accompanying drawings.

BRIEF DESCRIPTION OF THE DRAWINGS

FIGS. 1A and 1B are bottom views of two versions of the inventive two ring serving tray.

DETAILED DESCRIPTION OF THE INVENTION

Figure 2:
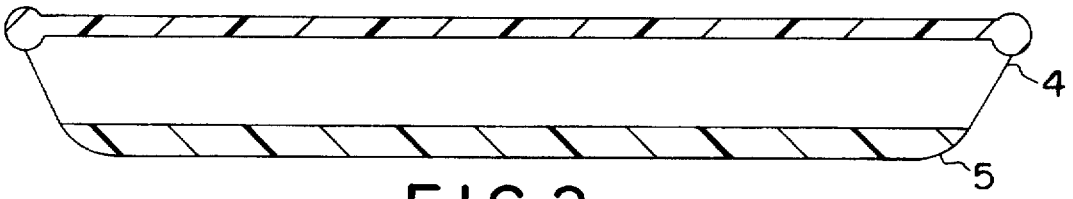
FIG. 2 is a side view of the inventive two ring serving tray.
Figure 3:
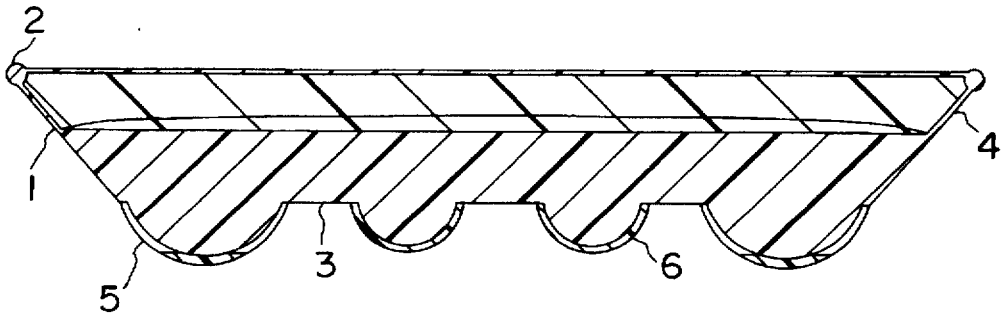
FIG. 3 is a cross-sectional cutaway view of FIGS. 1A and 1B.
Figure 4A:
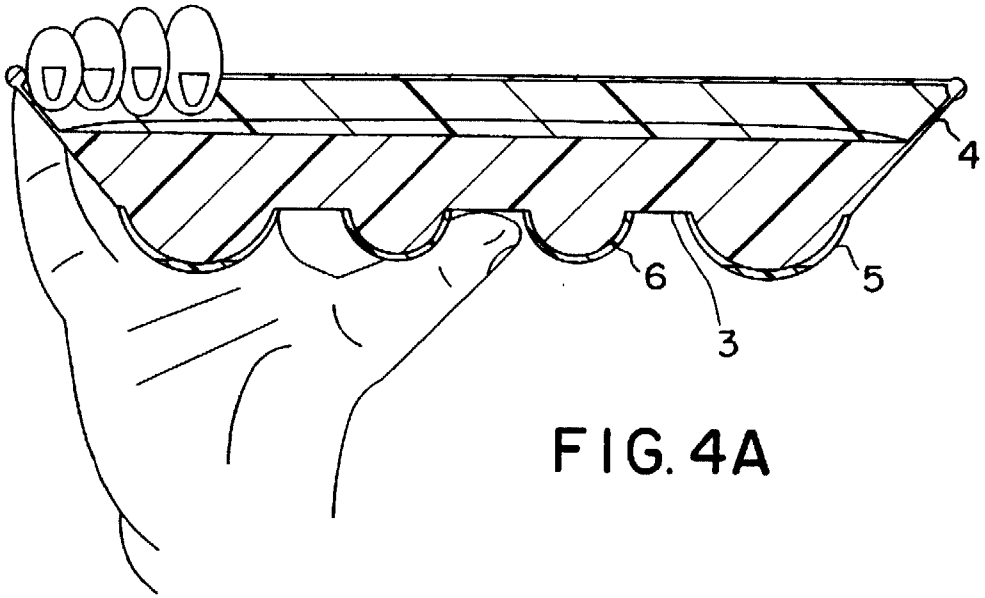
FIGS. 4A and 4B show a cross-sectional cutaway of the inventive two ring tray with digits, thumb and palm in an upright tray holding position (FIG. 4A) and maintaining a secure grip on the tray in an inverted position (FIG. 4B).
Figure 4B:
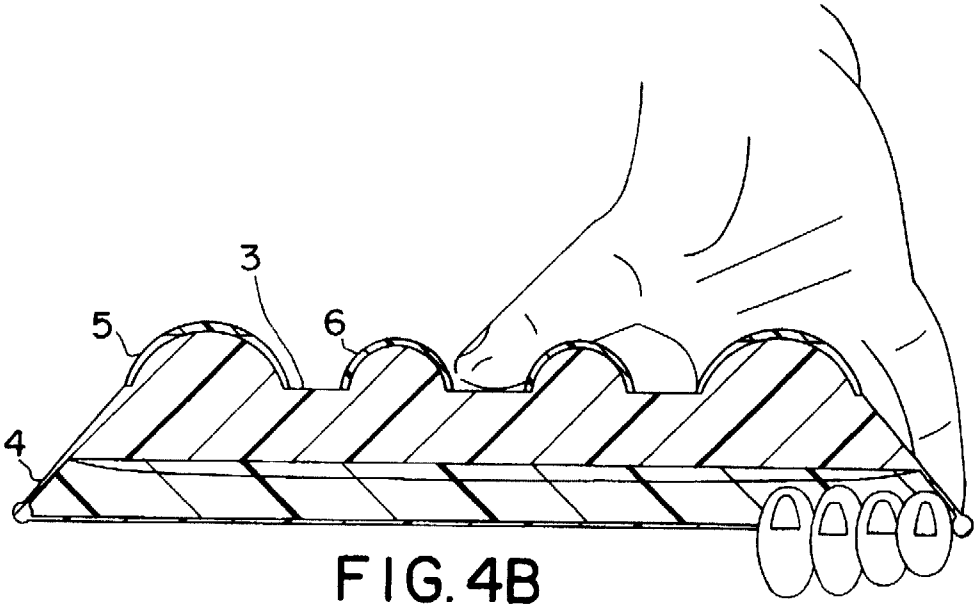

Referring to FIG. 3, there is shown a cutaway cross-sectional view of the inventive serving tray having a substantially planar top surface 1, optional tray rim 2, bottom surface 3, and periphery 4. As can be seen from the bottom view of FIG. 1A or 1B, outer hand-gripping base ring 5 and inner-stabilizing base ring 6 extend from the bottom surface and are positioned on bottom portion 3 so that when the hand-gripping base ring 5 is gripped by the palm and digits of a server's hand (FIG. 4), the inner-stabilizing base ring 6 can be engaged by the thumb thereof.

The concept of the inventive serving tray is that the thumb acts as a central fulcrum supporting the tray with peripheral counter-balance, support, and stability maintained by the palm and digits of the hand. This concept changes the role of the hand from that of a "balancing" system to that of a more secure "grip" system. It also incorporates a secure three-point fixation system between the thumb, the index finger, and another digit of the serving hand. It should be noted, however, that the inventive construction does not prevent the tray from being held in the traditional manner.

Figure 5B:
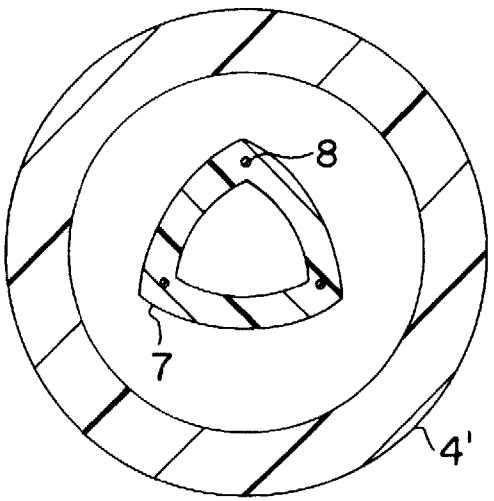
FIGS. 5A and 5B are bottom views illustrating modified versions of the tray comprising a single medial-base ring wherein a smooth, rounded, peripheral contour on the tray edge acts as a "pseudo-outer" base ring.
Figure 5A:
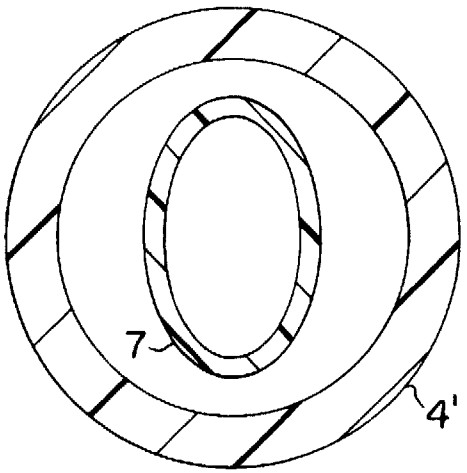
Figure 6:
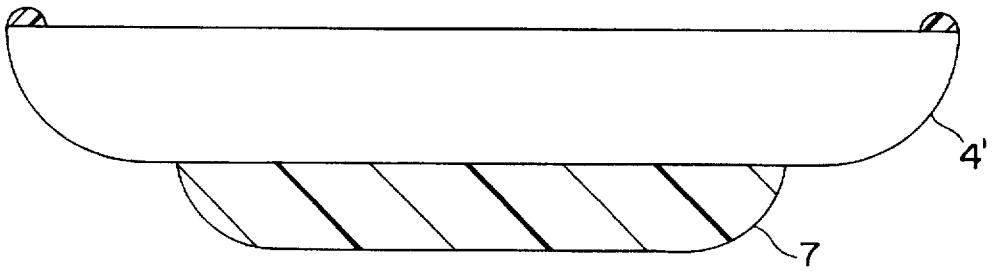
FIG. 6 is a side view of the tray shown in FIGS. 5A and 5B.

A first embodiment of the inventive serving tray has two concentric rings in the base, hereafter referred to as the inner-stabilizing base ring 6 which preferably has a ridged thumb-gripping surface and the outer hand-gripping base ring 5, which preferably has a smooth contour and a ridged base surface. A second embodiment, as shown in FIGS. 5A and 5B, has a single base ring, hereafter referred to as medial-base ring 7 and a smooth, rounded periphery 4', which acts as the required hand-gripping surface in a manner similar to hand-gripping base ring 5.

The invention embodies an inner- (embodiment 1) or medial-base ring (embodiment 2) against which the thumb can be placed with gentle pressure; a smooth, rounded surface around the periphery of the tray to follow the contour of the palmar surface of the hand allowing for a second and third point of stability while still being comfortable to the palm and digits by spreading the pressure equally against all sites; placement of ridges or coils, within the inner- or medial-base ring or texturizing the surface to increase thumb traction to prevent slippage; placement of ridges or coils on, or texturizing only the underside of the outer-base ring contour for further stability by preventing slippage when the tray is set on an open stand or wet surface; creation of a minute height differential between the shorter inner-base ring 6, and the longer outer-base ring 5 to allow the serving trays to stack; and an "eccentric elliptical" or "rounded triangular" shape of the inner- or medial-base ring to allow for different hand sizes, thus, creating a tray with universal applicability, ambidextrous function, and increased versatility.

In one embodiment of the invention, as shown in FIGS. 1–4, two rings are provided on the bottom surface or base of the serving tray, the inner-stabilizing base ring 6 and hand-gripping base ring 5. Larger serving trays tend to need two rings for adequate support. Each ring, hand-gripping base ring 5 and the inner-stabilizing base ring 6, can have contours which are substantially identical to each other so that that inner-base ring and outer-base ring are concentric. Alternatively, the inner-stabilizing base ring 6 can be made eccentric to the circular peripheral hand-gripping base ring 5 so that the gripping distance varies between portions of the inner and outer ring to accommodate size differences between the hands of individual servers. Two examples of this eccentric arrangement are illustrated in FIGS. 1A and 1B.

In a second embodiment of the invention, shown in FIGS. 5–8, called the single ring modified serving tray herein, a single medial-base ring 7 is provided. Medial-base ring 7 shares the qualities of the inner-stabilizing base ring 6, except for a more lateral position. Periphery 4' can be modified to have a smooth, rounded, peripheral contour which acts as the required outer hand-gripping surface. The single medial-base ring 7 and the smooth contour periphery 4' can have shapes which are substantially identical to each other so that ring 7 and outer periphery 4' are concentric. The single-ring modified tray is best utilized in the setting of smaller cocktail trays where a single ring will suffice. A more lateral position of the single base ring prevents the tray from tipping over if the dishes placed on its surface are not distributed equally.

The height of the outer hand-gripping base ring 5 can be made to exceed that of the inner-stabilizing base ring 6 in the two-ring model to allow for easy stacking of one tray on top of the other. The eccentric shape and presence of thumb-gripping ridges would limit the stability of the stack of trays if the inner and outer rings were to be of identical height. The greater height of outer ring 5 allows for easy stacking on top planar surface 1 of another tray. In the single ring model, the round or eccentric medial-ring does not interfere with the stacking ability of the trays nor does the texture of its surface.

Figure 7:
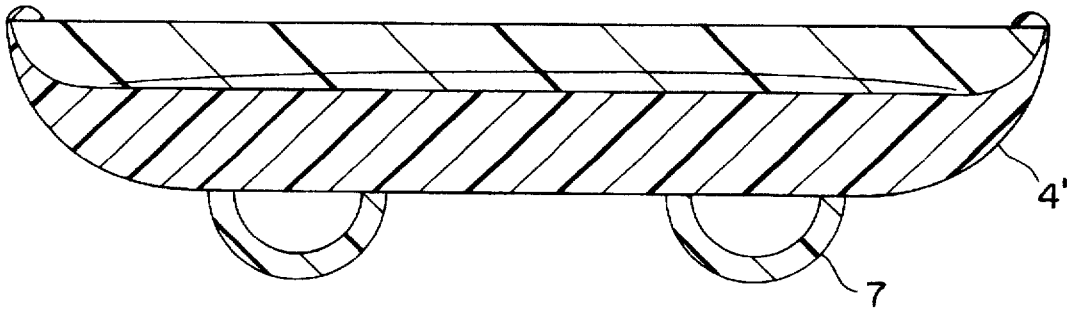
FIG. 7 is a cross-sectional cutaway view of FIGS. 5A and 5B.
Figure 8A:
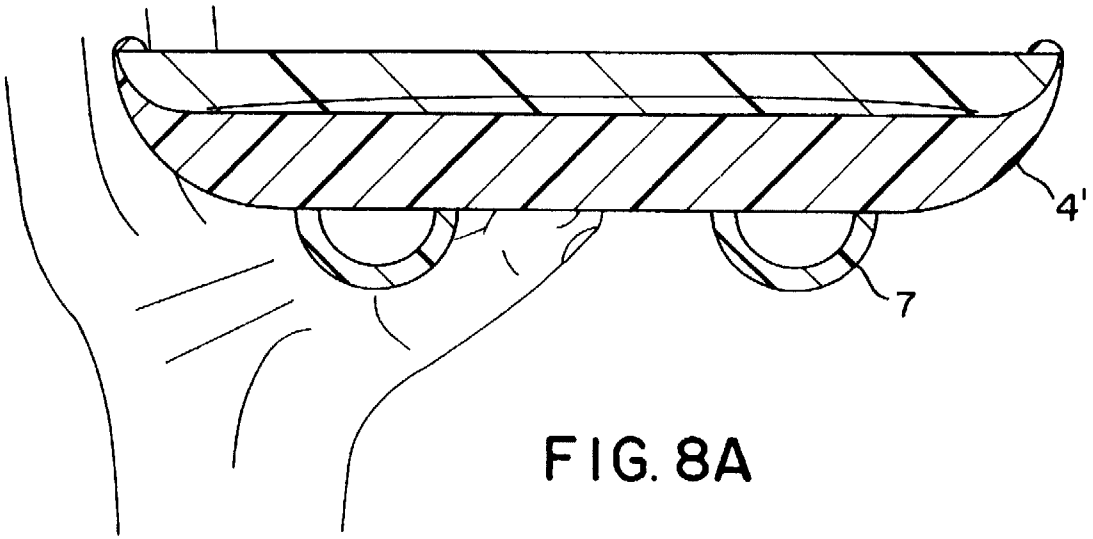
FIGS. 8A and 8B show a cross-sectional cutaway view of inventive single ring tray with digits, thumb and palm in an upright tray holding position (FIG. 8A) and maintaining a secure grip on the tray in an inverted position (FIG. 8B).
Figure 8B:
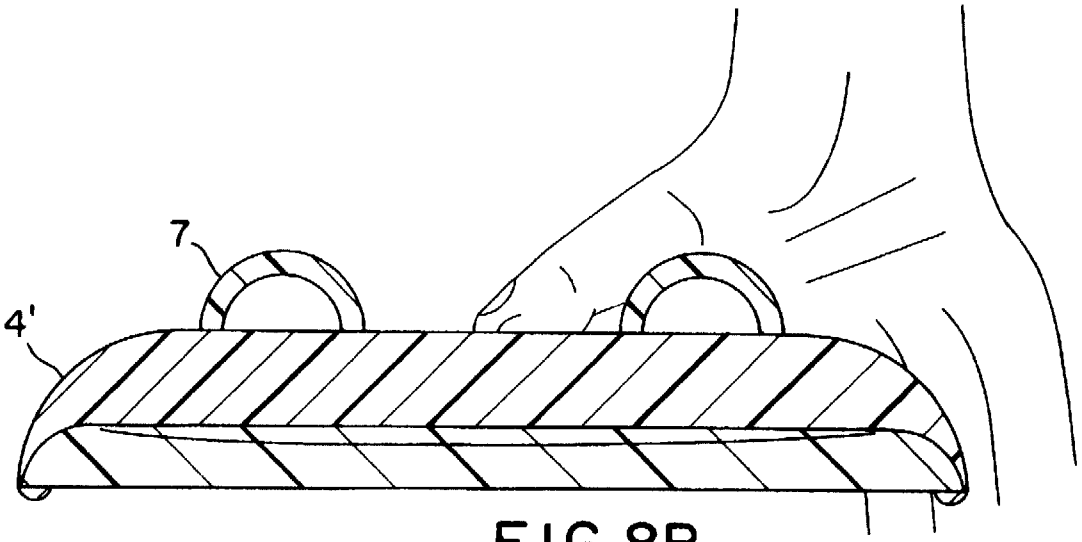

The inner and outer base rings in the two-ring model and the medial base ring in the one-ring model can be integrally molded with the tray portion with no moveable parts, screws, or rivets. Alternatively, either or both of the rings can be formed separately and attached to the underside of the tray portion after formation. The inner-stabilizing base ring 6 and the outer hand-gripping base ring 5 can be formed in any suitable configuration; FIG. 3 illustrates the use of two solid circular base rings; FIG. 7 illustrates a hollow, tubular base ring. The advantage of the hollow tubular ring is that the base is lighter and is more appropriate for lighter objects such as cocktail glasses. The advantage of the solid base ring is that the base support is stronger and can support heavier objects such as dishes laden with food. The inner-stabilizing base ring 6, the outer hand-gripping base ring 5, and the medial-base ring in the one-ring model 7 can be attached to tray portion 1 using any suitable means such as screws or rivets 8 as shown in FIGS. 1B and 5B. Preferably, the ring or rings of the invention will be placed so that they will still allow the tray to be used in a conventional manner. This will accommodate the server who prefers tradition to convenience.

While only the fundamental novel features of the invention as applied to a preferred embodiment thereof have been shown and described, it is understood that various omissions, substitutions, and changes in the form of details of the device illustrated and its operation may be made by those skilled in the art without departing from the spirit of the invention. It is therefore the intention of the Applicant that the invention be limited only as indicated by the scope of the claims appended hereto.

I claim:

1. A tray comprising a substantially planar portion having a rigid first surface adapted to receive articles to be carried on said tray, a second surface, and a side surface extending between said first surface and said second surface, said tray including a gripping surface substantially perpendicular to a plane defined by said first surface, and at least one base ring extending from said second surface in a direction away from said first surface, said gripping surface and said base ring being positioned on said tray whereby, when one of said gripping surface and said base ring is gripped by the fingertips of a server's hand, the other can be engaged by the thumb thereof, said gripping surface being a surface against which a gripping force sufficient to support said tray can be applied in a direction substantially parallel to said plane, said at least one base ring having a surface substantially parallel to said plane comprising a first portion and a second portion, said first portion being closer to said gripping surface than said second portion.

2. The tray of claim 1 wherein said side surface of said tray is said gripping surface.

3. The tray of claim 1 provided with at least two base rings on said second surface, the base ring remote from the center of said tray comprising said gripping surface.

4. The tray of claim 1 wherein at least one of said gripping surface and said base ring are integrally molded with said tray portion.

5. The tray of claim 1 wherein at least one of said gripping surface and said base ring are formed separately and are attached to said tray portion after formation.

6. The tray of claim 2 wherein said base ring is eccentric to said periphery.

7. The tray of claim 1 wherein said base ring is eccentric to said gripping surface and has an elliptical shape.

8. The tray of claim 1 wherein said base ring is eccentric to said gripping surface and has an oval shape.

9. The tray of claim 1 wherein said base ring is eccentric to said gripping surface and has a rounded triangular shape.

10. The tray of claim 1 wherein at least one base ring has a textured surface.

11. The tray of claim 1 wherein an inner base ring has a height less than that of an outer base ring thereby allowing for the stacking of trays.

12. The tray of claim 5 wherein said base ring is formed of hollow tubing.

* * * * *